US005107595A

United States Patent [19]

Stay et al.

[11] Patent Number: 5,107,595

[45] Date of Patent: Apr. 28, 1992

[54] ACCU-SQUARE MARKING SYSTEM

[76] Inventors: Frank Stay, Box 81, Middle Grove, N.Y. 12850; Robert Hoyt, Box 116, Centerline Rd., Galway, N.Y. 12074

[21] Appl. No.: 739,996

[22] Filed: Aug. 2, 1991

[51] Int. Cl.[5] ..... G01B 3/14

[52] U.S. Cl. ..... 33/1 G; 33/413; 33/562; 33/750

[58] Field of Search ..... 33/1 G, 1 LE, 413, 755, 33/756, 759, 760, 339, 453, 562

[56] References Cited

U.S. PATENT DOCUMENTS

| | | | |
|---|---|---|---|
| 299,625 | 6/1984 | Covell | 33/413 |
| 464,205 | 12/1991 | Swope | 33/756 |
| 759,313 | 5/1904 | Roe | 33/1 N |
| 884,904 | 4/1908 | Lashmutt | 33/1 N |
| 3,979,833 | 9/1976 | Grundman . | |
| 4,381,607 | 5/1983 | Place . | |
| 4,565,005 | 1/1986 | Naka . | |

FOREIGN PATENT DOCUMENTS

| | | | |
|---|---|---|---|
| 909344 | 10/1962 | United Kingdom | 33/562 |

*Primary Examiner*—Harry N. Haroian

*Attorney, Agent, or Firm*—Schmeiser, Morelle & Watts

[57] ABSTRACT

A marking system is disclosed that enables a user to lay out a foundation/perimeter for a structure without requiring the use of measuring instruments and/or complex procedures. The system includes six wire-like premeasured members that are releasably attached to specially designed corner members. The system is laid out with four of the wire-like members enclosing a square or rectangular area with their ends attached to the corner members. The remaining two wire-like members diagonally cross the enclosed area and each is attached at its ends to opposite corner members. When the diagonals intersect at their midpoints, the user is assured that the corners form right angles. Each of the diagonally placed members preferably includes a marking band at its midpoint to facilitate the locating of the midpoints by a user.

15 Claims, 2 Drawing Sheets

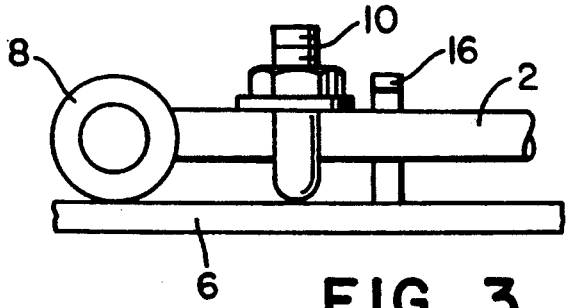
FIG. 3
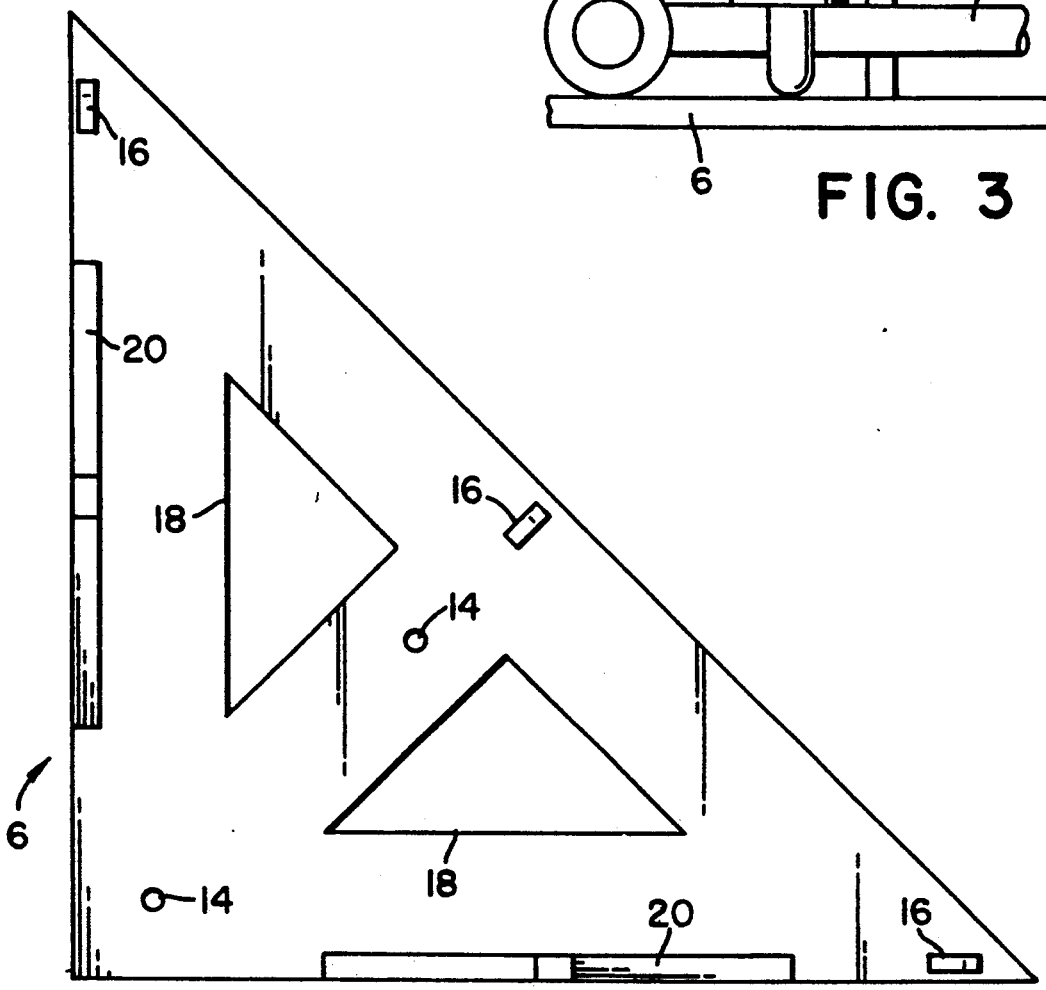
FIG. 4
FIG. 5
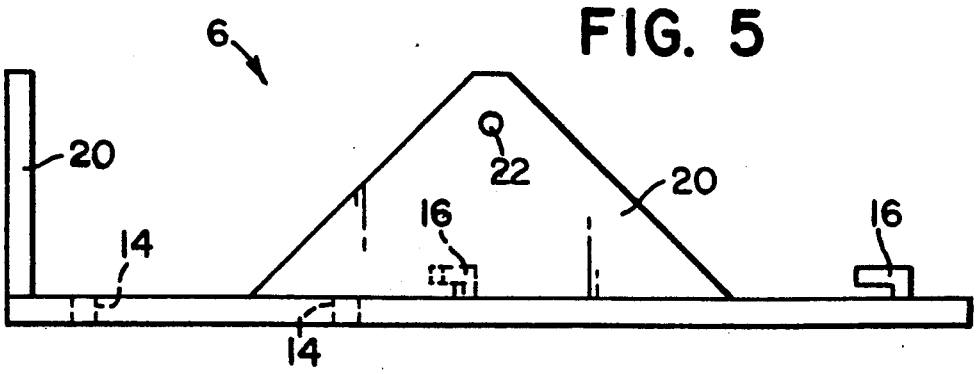

ACCU-SQUARE MARKING SYSTEM

FIELD OF THE INVENTION

The invention is in the field of geometrical instruments. More particularly, the invention is a system for marking the outer perimeter of a parallelogram-shaped area having ninety degree corners. The invention is primarily designed for use in laying out the foundation/perimeter of a room addition or of a free-standing building such as a house or garage.

BACKGROUND OF THE INVENTION

In the construction of any structure, the initial laying out and staking of the building's perimeter is critical to the successful completion of later stages of the building process. If the foundation is inaccurate, expensive corrective action may be required before the building is completed. If the building is erected with a poorly laid out foundation, many of the walls and corners will look out of true or will have required excessive construction time to overcome the initial inaccuracies.

There are two primary methods used for properly laying out a perimeter/foundation of a building. The first method requires the use of an expensive instrument such as an optical level or a transit level. The user initially starts from a known reference line or point and uses the instrument to find points for the structure's corners that are located in the proper angular orientation. The use of these types of instruments requires the operator to have considerable expertise and training to ensure accurate results.

The second method for laying out a perimeter/foundation of a structure involves the combined use of various measuring tools with basic geometry to mark the required perimeter. There are four well-known procedures of this type for accomplishing a correct laying out and staking of a perimeter for a square or rectangular area.

The first procedure requires the use of at least two steel measuring tapes. The builder first depicts the structure on paper once the exact wall lengths are known. Next, he or she calculates the length of a diagonal line that would connect opposite corners of the perimeter. This is accomplished using the Pythagorean method of calculating the hypotenuse of a right triangle (i.e.-hypotenuse squared equals the first side squared plus the second side squared). Using this information, the builder initially places two stakes at the proper location on the site to mark the corners of one wall of the structure. Next, the locations of the adjoining sides are determined in the following manner. First, a steel tape measure is extended the length of one of the sidewalls with one end of the measure at the appropriate corner stake. The outer end of the measure is then placed at the approximate position of the outer corner. A second tape measure is then placed at the other initially-placed stake and extended out a distance equal to the diagonal of the area to be enclosed by the perimeter. The outer end of each measure is then brought together and this effectively marks one of the outer corners of the perimeter. The builder then places a stake in the ground at this location. The procedure is then used a second time to locate and stake the fourth corner of the perimeter. The builder then connects each of the stakes with wire or string and the marking of the perimeter/foundation of the structure is complete.

If multiple tape measures are not available, a single tape measure can be used to perform a similar procedure to that described above. The builder initially places two stakes to mark one side of the perimeter. Next, he or she places a tape measure at the first initially-placed stake and extends it a distance equal to the length of the appropriate side. The builder orients the extended tape in a direction approximately perpendicular to the line formed by the two initially-placed stakes. Once the measure is fully extended, the outer end of the measure is used to draw an arc in the ground at the approximate location of the first of the outer corners. The builder uses the above procedure a second time to draw an arc at the approximate location of the second of the outer corners. Next, the builder starts at one of the known corners and extends the tape measure a distance equal to a diagonal of the area to be enclosed and brings the end of the tape measure to what will be the opposite corner. The outer end of the measure is then used to draw another arc on the ground. Where the new arc and the previously drawn arc cross, a stake is placed in the ground and this marks the location of an outer corner of the structure. This step is repeated to find the fourth corner of the structure. In this procedure and the one detailed above, once the four corners are staked, the builder will commonly use the tape measure and again measure the diagonal distance between the corners of the enclosed area. If each corner is a right angle, the two measured diagonals will be equal in length.

A third procedure sometimes used also relies on basic trigonometry. The user initially measures and stakes out the first two corners of a perimeter. Next, starting from one end, he or she measures out the length of an adjoining side and places a stake at the outer end. The person then checks the angle formed by using the "3-4-5" rule of a right triangle (i.e.-a right triangle will be formed by any structure having sides that are in the ratio of 3-4-5). This is accomplished by first measuring along one side some number of three-foot units. The user then measures an identical number of four-foot units on the adjoining side. A tape measure is then placed between the measured outer points and if the tape measure reads a like number of five-foot units, the angle between the two adjacent sides is exactly ninety degrees. When the angle is determined to be more or less than ninety degrees, the outer stake(s) is moved appropriately and the angle is again checked. The user then repeats the procedure from the other initially-staked corner to find the fourth corner. Once the corners have been marked, the user measures the diagonal distances of the enclosed area to ensure that they are the same length and thereby again checks that the included angles of the corners are right angles.

The last of the procedures of this type makes use of an oversized right triangle normally fabricated from wood. The triangle usually will have one three-foot long side, a four-foot long side and a hypotenuse that is five feet in length. As in the previous procedures, the user initially stakes the two ends (corners) of one side of the perimeter. The user then places the wooden triangle at each corner and sights along each side of the triangle to determine the direction of the sides of the perimeter. The user then measures out and stakes the outer two corners. Following this, the user again measures the diagonals to ensure the accuracy of each included corner angle. This last method, while being the simplest, depends on the user finding perfectly straight lengths of wood for the fabrication of the triangle. In addition, the user must visually determine the layout of the sides. Therefore, this last method can be extremely frustrating to use and can lead to an inaccurately laid out perimeter/foundation.

Each of the above methods is somewhat complicated and requires a large amount of user experience before accurate results can be reliably achieved.

The first objective of the invention is to provide a user with an apparatus that he or she can employ to quickly and accurately lay out and stake a perimeter/-foundation of a structure.

The second objective of the invention is to provide an apparatus that does not require a person to have extensive prior experience o to perform trigonometry calculations in order to achieve accurate results.

A third objective of the invention is to provide an apparatus for laying out a perimeter/foundation that is low in cost. This is unlike the high cost of an optical level or transit which requires multiple usages to warrant its purchase.

A fourth objective of the invention is to provide a low cost and accurate apparatus that has multiple applications in the construction field such as in the laying out of floors, vertical framing and roof structures.

The invention can be used by a professional builder who wishes to avoid the use of fragile measuring instruments or by a typical homeowner who wishes to purchase a garage or deck kit and build it himself. For many people, laying out and staking a foundation can be a daunting task. This causes them to avoid a project they could otherwise accomplish. By using the invention, any person can quickly, easily and accurately lay out and stake a perimeter/foundation.

SUMMARY OF THE INVENTION

The invention is a system for accurately laying out a perimeter for a square or rectangular area. The system is preferably used in the construction field as a first step in the construction of a horizontal base or foundation for a building or building addition. The system can also be used to check the alignment and accuracy of a vertically oriented wall or partition.

In the preferred embodiment, the invention comprises a number of fixed length wire-like flexible members that can be attached to four specially-designed corner members. Each of the flexible members is used to identify either one side of the enclosed area or a diagonal line between its opposite corners. To lay out a square or rectangular area, six flexible members are used. In laying out a square area, four of the six members are identical in length and each is equal to the length of one side of the enclosed area. The remaining two flexible members each have a length equal to a diagonal between opposite corners of the enclosed area. A rectangular area will also require the use of six flexible members; however, the four members that are used to mark the sides will be of two different lengths. The flexible members that diagonally cross the enclosed square or rectangular area will be equal in length and longer than any of the other four flexible members used.

In staking out an area, each of the above mentioned flexible members is attached to one of four identical specially-designed corner members. Each corner member is adapted to be easily mounted to either a horizontally or vertically oriented support. Once the corner member is in place, it can be pivoted on the support (a stake, for example) to enable the flexible members to be easily manipulated and the other corner members to be adjustably located.

Once the flexible members have been laid out and attached to the corner members, they will enclose the desired area. The flexible members that diagonally cross the enclosed area form an "x"-shaped pattern that is centered in the enclosed area If the outer flexible members have been laid out properly and the corners form ninety-degree angles, both diagonally extending flexible members will cross at their midpoints and be taut. For a square enclosed area, the diagonal flexible members will also be perpendicular to each other at the point of intersection. In a rectangular area, the diagonals will also cross at their midpoints with two sets of equal angles located at their crossing point.

In the preferred embodiment, each of the diagonally crossing flexible members will also include at their midpoint an identifying mark such as a colored band. When all of the flexible members have been laid out and the enclosed area has ninety degree corners, the colored bands of the diagonally crossing flexible members will lie one atop the other at the center of the enclosed area. This facilitates the user's determination that the diagonals are crossing at their midpoints.

BRIEF DESCRIPTION OF THE DRAWINGS

FIG. 3 is a side view of a flexible member that includes an optional stop member.

FIG. 4 is a top view of one of the corner members to which three of the flexible members will be attached.

FIG. 5 is a side view of the corner member shown in FIG. 4.

DETAILED DESCRIPTION OF THE DRAWINGS

Figure 1:
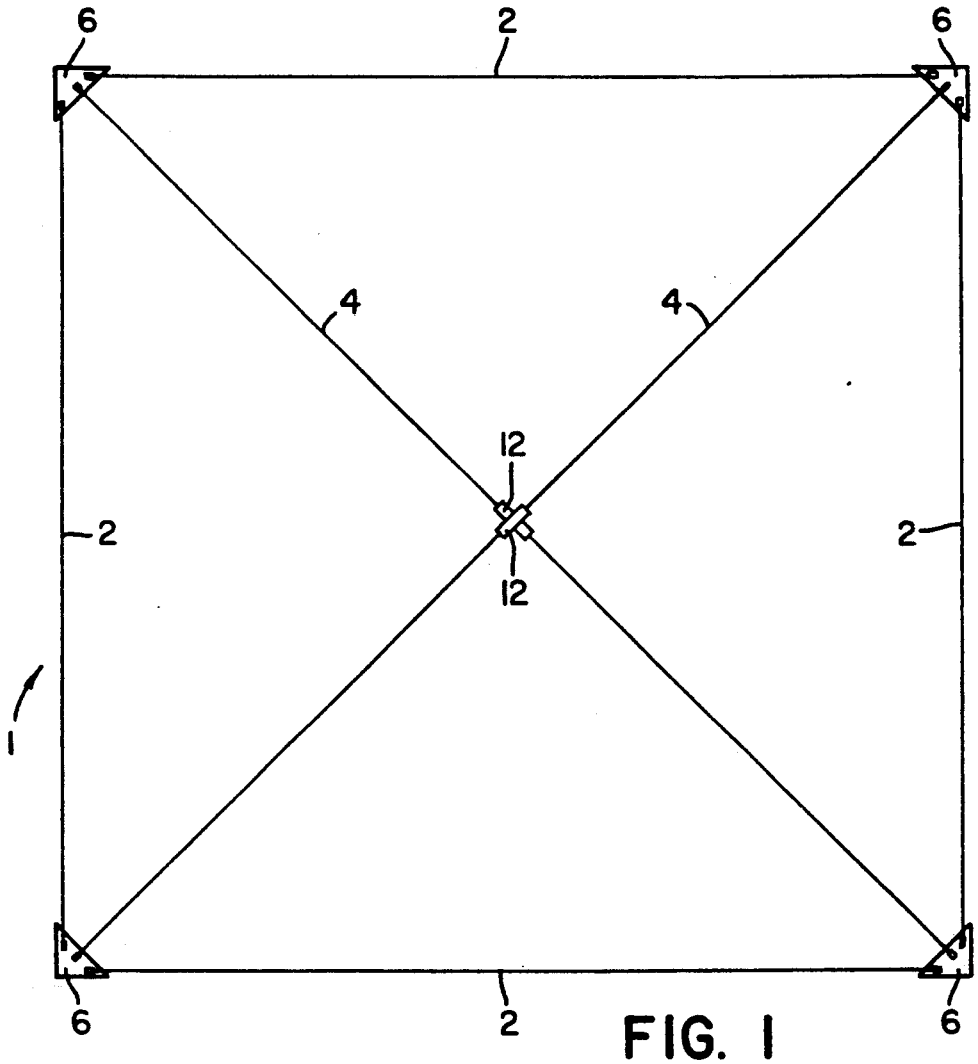
FIG. 1 is a plan view of the apparatus marking out a square area.

Referring now to the drawings in greater detail, wherein like reference characters refer to like parts throughout the several figures, there is shown by the numeral 1 a marking system in accordance with the invention that is being used to mark a square perimeter.

As shown, the system includes four flexible members 2 that are used to mark the perimeter of an area. When a square area is being marked, each flexible member 2 is equal in length. The system further comprises two flexible members 4 that are longer than the members 2 and are sized to diagonally extend between opposite corners of the marked perimeter. All of the flexible members are preferably made from a non-stretchable material such as wire cable so that their length will not change after repeated uses. Additionally, the flexible members should all be made from the same material to ensure that expansion or contraction due to temperature changes will affect all of the members in a substantially equal manner. Each of the flexible members has its end portions attached to two of the four corner members 6 as shown. The corner members are each made from a rigid material such as metal or a thick plastic. A ring 8 (shown in FIG. 2) or similar structure is located at each end of the flexible members to facilitate the attachment of the members to the corner members. The flexible members will normally be provided in premeasured form. If the user wishes to employ the system to mark an area of a different size, apparatus such as adjustably movable cable clamps 10 (shown in FIG. 3) may be added to each of the flexible members. Once the clamps are suitably located on the flexible members, they act as stop members and provide new points for securing the outer portions of the flexible members to the appropriate areas of the corner members.

At the midpoint of each of the diagonal members 4 is an indicator marker such as a colored band 12. The bands facilitate the user locating the longitudinal midpoint of each of the diagonally extending members. Other types of markers such as clamps or colored marks may alternatively be used. When the perimeter is correctly laid out, each corner will form a ninety-degree angle. When the enclosed area is bounded by a perimeter having four ninety-degree corners, the two diagonally extending members 4 will intersect at their midpoints and the bands 12 will lie one atop the other as shown. For a square perimeter, the diagonal members will be perpendicular at their point of intersection.

Figure 2:
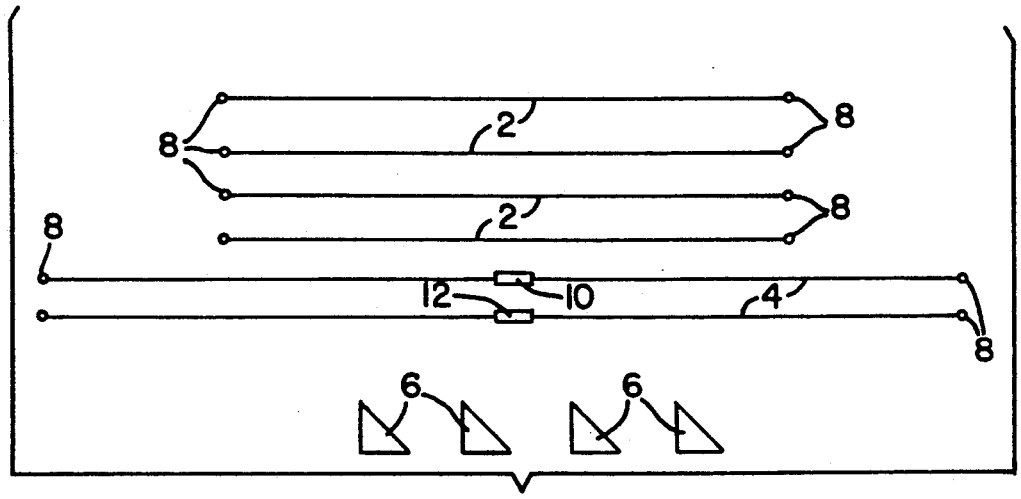
FIG. 2 is a plan view of the apparatus of FIG. 1 shown in an unassembled state.

FIG. 2 shows the components of the system in an unassembled state. As can be seen, there are two different lengths of flexible members used when marking a square perimeter. The system can also be used to mark a rectangular area. For the latter case, three different lengths of flexible members would be used with two of the lengths equal to the outer sides of the marked perimeter and the third length equal to the diagonal distance between the area's opposite corners.

FIG. 4 provides a detailed top view of one of the specially-designed corner members 6. FIG. 5 provides a view of the same member as seen from the side. Each corner member is triangular in shape and includes at least one aperture 14 through which a nail or stake can pass. The nail or stake would then be inserted into the ground or some other type of retaining structure to secure the corner member from inadvertent movement. In FIG. 4, two such apertures are shown. Located proximate a front side of the corner member are three hook members 16 that are each designed to secure an end portion of one of the flexible members 2 or 4. The hook members function in either of two manners. Firstly, each hook member can inwardly receive one of the rings 8 located at the extreme ends of the flexible members. Alternatively, when adjustable clamps are used, a portion of the flexible member can be located within the hook member in a position where the clamp abuts the side of the member and thereby acts to stop or limit the passage of the flexible member through the hook member (note FIG. 3).

Located in the main body of the corner member are two large apertures 18 that allow the user to see through the member and thereby facilitates the securing of the member. When the corner member is manufactured from a clear plastic, the apertures may be dispensed with since the user would be able to see through the plastic.

Positioned on each of the two rear sides of the corner member is an ear 20 that perpendicularly extends from the main triangular base portion of the member. The ears are preferably triangular in shape and are unitary portions of the corner member. In a corner member made from metal, the ears are a part of the original stamping and are bent as shown. Each ear includes at least one aperture 22 through which a nail or similar fastener can pass in order to affix the ear of the corner member to a vertically extending support surface. It should be noted that while two ears are shown on the corner member, a corner member can be made without ears or having any number of ears depending on the desired usage.

In the preferred method of use, the user first attaches all of the flexible members 2, 4 to the associated corner members by placing their rings 8 into the proper hooks 16. Next, he or she determines the location of one side of the area to be enclosed. Following this, the user stakes out the first two corner members in the appropriate locations by separating them along the line of the determined side until the flexible member between them is taut. To stake the corner members, the user will normally place a long nail or stake through one of the apertures 14 in each of the corner members and drive the nail or stake into the ground or an analogous retaining structure. The user then separates the other two corner members until the flexible members 2 between them and the fixed two corners are taut. At this point, the user checks that the diagonally extending flexible members 4 are taut and that they cross at their midpoints. In the preferred embodiment, the bands 12 that are located at the midpoint of each of the diagonal members 4 will be positioned one atop the other when the diagonals are intersecting at their midpoints. When the marks are properly aligned, this indicates that the perimeter corners each enclose ninety degrees and the perimeter is a true square or rectangle. If the marks are not aligned, the user can quickly and easily adjust the location of the outer two corner members' until the proper alignment is achieved. It should be noted that when only a single nail or stake is used to secure the corner members, a pivotal motion of the corner members is allowed thereby facilitating the above mentioned adjustment process. Once the alignment is correct, the user stakes the outer two corner members. At this point, the foundation/perimeter of the structure is properly and accurately laid out.

The invention can also be used to check the alignment of a vertically extending wall or other structure using the same apparatus with a similar method. The user first attaches the flexible members to the corner members. Next, two of the corner members are secured at spaced locations along one side of the structure being checked. The other two corner members are then secured to the opposite corners of the same structure. When the diagonal members intersect at their midpoints as preferably indicated by an overlapping of their central marks, the user knows that each of the four corners of the vertical structure forms a right angle and is properly aligned.

It should also be noted that while the specially designed corner members facilitate use of the system, the set of flexible members may be used without the corner members. A user would first either insert stake-type members through the rings 8 or attach the clamps 10 (if used) to a similar form of support. Next, the user would extend the flexible members until they are all taut. The user would then adjust the corners until the diagonally extending members intersect at their midpoints. At this point, the perimeter would be properly marked and the flexible members could be secured.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A marking system for laying out square or rectangular perimeters comprising:

six flexible members that each have first and second end portions;

attaching means located proximate the first and second end portions of each of said flexible members for attaching the associated end portion to a securing means that secures the associated end portion from inadvertent movement; and indicating means located at a longitudinal midpoint of two of said flexible members for indicating said midpoints to a user;

whereby when a user lays out the flexible members in a manner wherein four of said flexible members enclose an area having four outer corners and connect to each other at said corners and wherein two of said flexible members having indicating means at their midpoints are also attached to said corners and diagonally cross the area in an "x"-shaped pattern with their indicating means located at the point where the two members cross, each of the four corners will form a right angle.

2. The system of claim 1 further comprising four corner members that each include three spaced receiving members wherein each receiving member can function to releasably retain one of the attaching means of the flexible members and wherein the corner members at least partially function as the securing means for the flexible members.

3. The system of claim 2 wherein each of said corner members includes a base portion and at least one ear portion that extends in a direction perpendicular to the base portion.

4. The system of claim 1 wherein the indicating means is a band that is wrapped about an exterior surface of the associated flexible member.

5. The system of claim 1 wherein at least one of the attaching means can be adjustably located on the associated flexible member.

6. A marking system for laying out square or rectangular perimeters comprising:

six flexible members that each have first and second end portions;

attaching means located proximate the first and second end portions of each of said flexible members for attaching the associated end portion to one of a plurality of securing means that secures the associated end portion from inadvertent movement;

wherein each of said securing means at least partially comprises a rigid corner member that includes three spaced receiving members that function to releasably receive and retain the attaching means of the associated flexible member;

wherein a user can mark a perimeter of a four-sided area having ninety degree corners by attaching the flexible members to the corner members in a manner whereby two flexible members extend diagonally across the area and form an "x"-pattern and the remaining four flexible members are attached to the corner members in a manner whereby they enclose the area and each forms a side of the perimeter; and midpoint indicating means located at a longitudinal midpoint of each of the two flexible members used to diagonally cross the enclosed area whereby the midpoint indicating means of each of the two diagonally crossing members will both be located at the point where the two flexible members cross when each of the four corners forms a right angle.

7. The system of claim 6 wherein the indicating means is a band that is wrapped about an exterior surface proximate the longitudinal midpoint of the associated flexible member.

8. The system of claim 6 wherein each of said corner members includes a base portion and at least one ear portion that extends in a direction perpendicular to the base portion.

9. The system of claim 6 wherein at least one of the attaching means can be adjustably located on the associated flexible member.

10. A marking system for laying out square or rectangular perimeters comprising:

six flexible members of predetermined lengths wherein each member has a first end portion and a second end portion and wherein two of said members are equal to each other in length and are each longer than the other four members;

attaching means located proximate the first and second end portions of each of said flexible members for attaching the associated end portion to an associated securing means that secures the end portion from inadvertent movement;

indicating means located at a longitudinal midpoint of each of the two longest flexible members for indicating to a user the location of said midpoints;

four corner members that each include three spaced receiving members that function to releasably retain the attaching means of the flexible members and at least partially function as the securing means for the flexible members; and wherein a user can mark a perimeter of a four-sided area having ninety-degree corners by attaching the flexible members to the corner members in a manner whereby the two longest flexible members extend diagonally across the area and form an "x"-shaped pattern and the remaining four flexible members are attached to the corner members in a manner whereby they enclose the area and each forms a side of the perimeter.

11. The system of claim 10 wherein the indicating means is a band that is wrapped about an exterior surface proximate the longitudinal midpoint of the associated flexible member.

12. The system of claim 10 wherein each of said corner members further comprises at least one aperture through which a fastener means may be placed to attach the corner member to a support means.

13. The system of claim 10 wherein each of said corner members includes a base portion and at least one ear portion that extends in a direction perpendicular to the base portion.

14. The system of claim 13 wherein each of said ear portions includes at least one aperture through which a fastener means may be placed to attach the corner member to a support means.

15. The system of claim 10 wherein at least one of the attaching means can be adjustably located on the associated flexible member.

* * * * *